US008226533B2

(12) United States Patent
Wessels et al.

(10) Patent No.: US 8,226,533 B2
(45) Date of Patent: Jul. 24, 2012

(54) MULTIPURPOSE EXERCISE DEVICE

(75) Inventors: Chad D. Wessels, Minneapolis, MN (US); Jerrod L. Iunghuhn, Minneapolis, MN (US)

(73) Assignee: Chad D. Wessels, Minneapolis, MN (US)

( * ) Notice: Subject to any disclaimer, the term of this patent is extended or adjusted under 35 U.S.C. 154(b) by 28 days.

(21) Appl. No.: 12/459,322

(22) Filed: Jun. 30, 2009

(65) Prior Publication Data

US 2009/0325768 A1 Dec. 31, 2009

Related U.S. Application Data

(60) Provisional application No. 61/133,524, filed on Jun. 30, 2008.

(51) Int. Cl.
*A63B 21/065* (2006.01)
*A63B 22/16* (2006.01)
*A63B 23/02* (2006.01)

(52) U.S. Cl. ..... 482/105; 482/79; 482/132; 482/140; 482/141

(58) Field of Classification Search ..... 482/79, 482/80, 92–96, 98, 105, 110, 131, 132, 140, 482/141, 145–147, 907, 78, 85, 148; 248/910; 177/204; 297/423.46, 423.41; D21/683, D21/685; 36/1; 601/32; 472/102, 114; 128/845; 446/325, 396; 280/14.21, 14.22, 18, 18.1, 280/19, 816, 818
See application file for complete search history.

(56) References Cited

U.S. PATENT DOCUMENTS

| | | | | | |
|---|---|---|---|---|---|
| 1,270,219 | A | * | 6/1918 | Schwarz | 472/114 |
| 1,990,970 | A | * | 2/1935 | Wood | 36/132 |
| 2,665,519 | A | * | 1/1954 | Burkes | 472/129 |
| 2,700,832 | A | * | 2/1955 | Slovinski | 36/140 |
| 2,748,838 | A | * | 6/1956 | Scholl | 297/423.41 |
| 2,849,237 | A | * | 8/1958 | Simithis | 482/105 |
| 3,716,880 | A | * | 2/1973 | Sorenson | 441/67 |
| 3,734,493 | A | | 5/1973 | Hasekian | |
| 3,767,191 | A | * | 10/1973 | Riley | 482/25 |
| 3,895,795 | A | * | 7/1975 | Merz | 482/8 |
| 3,950,808 | A | * | 4/1976 | Sorenson | 441/67 |
| 4,003,571 | A | * | 1/1977 | Nipper, Jr. | 472/114 |
| 4,212,458 | A | | 7/1980 | Bizilia | |
| 4,258,910 | A | * | 3/1981 | Carter | 472/133 |
| 4,322,072 | A | | 3/1982 | White | |
| 4,349,193 | A | | 9/1982 | Lambert, Jr. et al. | |
| 4,429,869 | A | * | 2/1984 | Eckstein | 482/71 |
| 4,686,781 | A | * | 8/1987 | Bury | 36/132 |
| 4,807,873 | A | | 2/1989 | Naquin | |
| 4,896,879 | A | * | 1/1990 | Klawitter | 482/105 |

(Continued)

OTHER PUBLICATIONS

Article entitled, "AbsZone; Feel the Burn!", from Internet website, http://www.abszone.com/awo twist.html, pp. 1-2, retrieved May 15, 2008.

(Continued)

*Primary Examiner* — Loan Thanh
*Assistant Examiner* — Victor K Hwang
(74) *Attorney, Agent, or Firm* — Kinney & Lange, P.A.

(57) ABSTRACT

A multipurpose exercise device has a portable construction, and is geometrically optimized with arcuate and planar surfaces to allow a safe and effective workout of the abdominal muscles when attached to the feet of a user. Furthermore, the device enables a user to efficiently transition from an oblique abdominal exercise to a core abdominal exercise in a highly efficient, hassle-free manner.

22 Claims, 4 Drawing Sheets

U.S. PATENT DOCUMENTS

| | | | | | |
|---|---|---|---|---|---|
| 4,900,017 | A | * | 2/1990 | Bold, Jr. | 482/132 |
| 5,004,229 | A | * | 4/1991 | Lind | 482/132 |
| 5,102,123 | A | | 4/1992 | Roark | |
| 5,248,287 | A | | 9/1993 | Nicoletti | |
| 5,461,799 | A | * | 10/1995 | Kim | 36/7.2 |
| D367,369 | S | * | 2/1996 | Lovegrove et al. | D6/349 |
| 5,573,483 | A | | 11/1996 | Nay | |
| 5,593,373 | A | * | 1/1997 | Hale | 482/75 |
| 5,643,165 | A | | 7/1997 | Klekamp | |
| 5,716,305 | A | | 2/1998 | Selsam | |
| 5,791,957 | A | * | 8/1998 | De La Cierva, Jr. | 441/65 |
| 5,846,108 | A | * | 12/1998 | Milford | 441/67 |
| 5,935,047 | A | | 8/1999 | Cawley | |
| D413,948 | S | | 9/1999 | Dalebout | |
| 6,312,361 | B1 | * | 11/2001 | Hayes | 482/51 |
| 6,450,928 | B1 | | 9/2002 | Larkins, Jr. | |
| 6,485,399 | B2 | | 11/2002 | Greene | |
| 6,592,497 | B2 | | 7/2003 | Greenheck | |
| 6,652,421 | B1 | | 11/2003 | Chen | |
| 6,746,386 | B1 | * | 6/2004 | Huang | 482/140 |
| 6,945,919 | B2 | | 9/2005 | Yang | |

OTHER PUBLICATIONS

Article entitled, "Shapes for Women; Hydraulic Fitness Equipment & Fitness Centers Tools", from Internet website http://www.shapesfor-women.com/equipment/rotator.asp, pp. 1-2, retrieved May 15, 2008.

* cited by examiner

LENGTH
13
14
18
20
28
10
22
15
26
12
24

10
13
30C
30B
30A
18
32
16
34
15
38
12
36

MULTIPURPOSE EXERCISE DEVICE

CROSS-REFERENCE TO RELATED APPLICATION(S)

This application claims the benefit of U.S. Provisional Application No. 61/133,524 filed on Jun. 30, 2008, for "MULTIPURPOSE EXERCISE DEVICE" by Chad D. Wessels and Jerrod L. Iunghuhn, which is incorporated herein by reference.

BACKGROUND

The present disclosure relates in general to a multipurpose exercise device, and more particularly, to a multipurpose exercise device that can be used for an efficient and effective abdominal muscle workout.

A variety of exercises employing rotational movement of the torso are known for strengthening the oblique abdominal muscles. One of the most common and simplest exercises is the torso or waist twist. This exercise is performed upright with feet planted firmly on the ground, while the exerciser alternately contracts and relaxes the oblique muscles to twist the upper torso rotationally clockwise and counterclockwise. To increase the difficulty of the exercise, the exerciser may add mass to his/her upper torso, for example, by holding a weightlifting bar on his/her shoulders with arms outstretched along the bar, or by holding an exercise ball with arms outstretched. The addition of mass has the effect of increasing the rotational inertia of the exerciser, requiring more work to both start and stop the rotation. However, the momentum inherent in this exercise also prevents the exerciser from fully working the oblique muscles throughout the whole range of rotational motion, instead causing these muscles to primarily contract in short bursts at the start and stop of each motion while allowing the muscles to rest during the intermediate range of motion.

In order to increase the work required throughout the rotational movement, exercise machines offering a continuous resistance have been used. For example, the exerciser may use a standard cable cross-over machine to provide weighted resistance throughout the motion by holding onto the cables. Additionally, other exercise machines exist where the exerciser holds his/her torso stationary and is forced to use the oblique muscles to rotate the lower body, for example, on a rotatable chair or surface connected to a weight or other resistance. However, such exercise machines often employ a number of complicated working parts requiring costly materials and that furthermore are prone to failure, thus necessitating routine maintenance. Additional drawbacks include the non-portability of many exercise machines, the large amount of floor space required for their operation, the sometimes unattractive appearance of their multiple linked components, and the limited functionality of some of these devices for working only a few isolated abdominal muscles.

SUMMARY

A multipurpose exercise device of portable construction, attachable to the feet of a user, is geometrically optimized with arcuate and planar surfaces to allow a user to effectively exercise the oblique abdominal muscle groups while also allowing an efficient transition into a multitude of abdominal exercises utilizing the same device.

DETAILED DESCRIPTION

Described herein is a multipurpose exercise device and method of using the device. The multipurpose exercise device of the present disclosure is of a low-cost, simple, and portable construction having an aesthetically pleasing design, and is geometrically optimized to allow a safe and effective workout of all of the major abdominal muscle groups when attached to the feet of a user. Furthermore, the combination of arcuate and flat surfaces on the device enables a user to efficiently transition from an oblique abdominal exercise to a core abdominal exercise with little or no hassle, and without the need for changing from one device to another.

Figure 1:
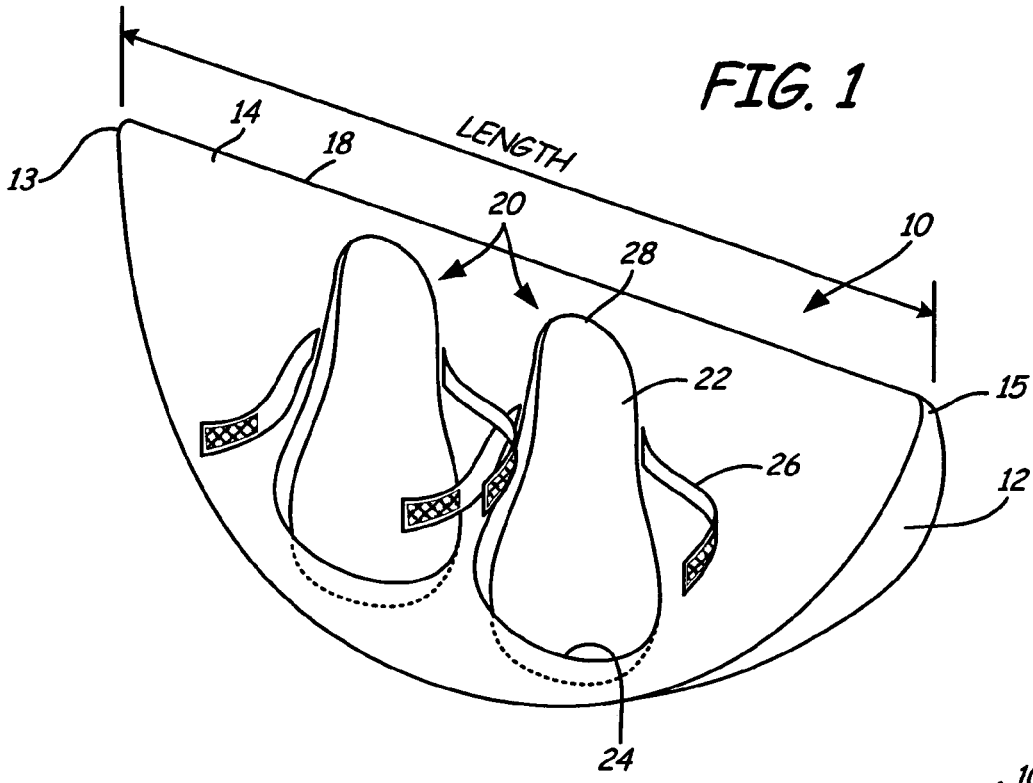
FIG. 1 is a perspective view showing an embodiment of a multipurpose exercise device.
Figure 2:
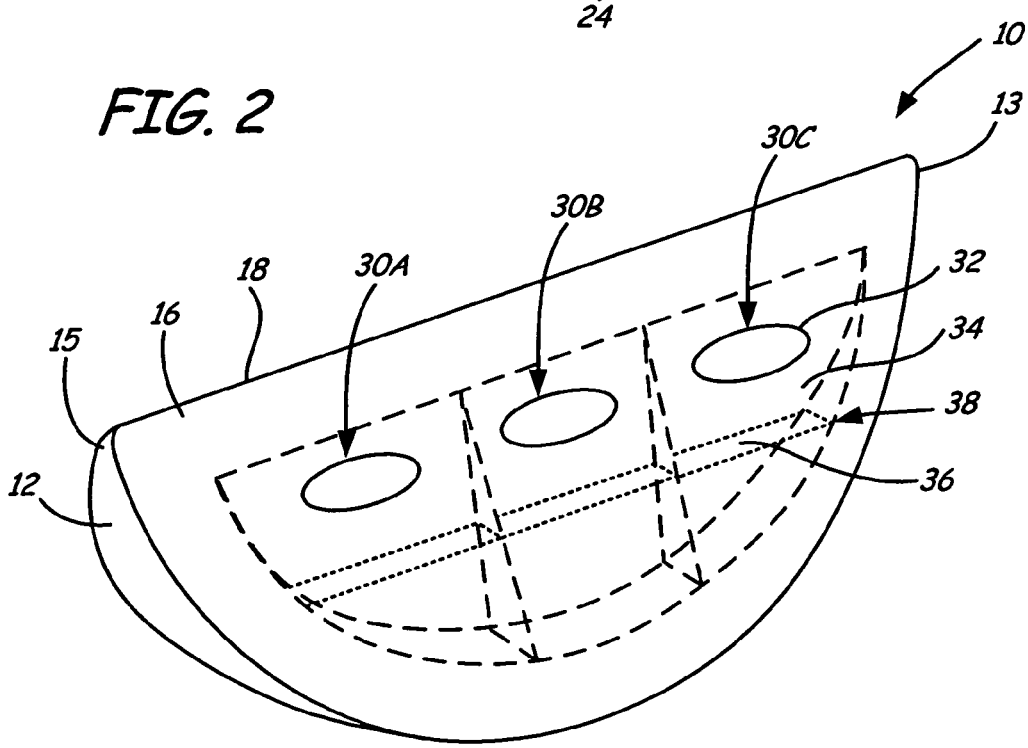
FIG. 2 is a perspective view showing the other side of the embodiment shown in FIG. 1.
Figure 3:
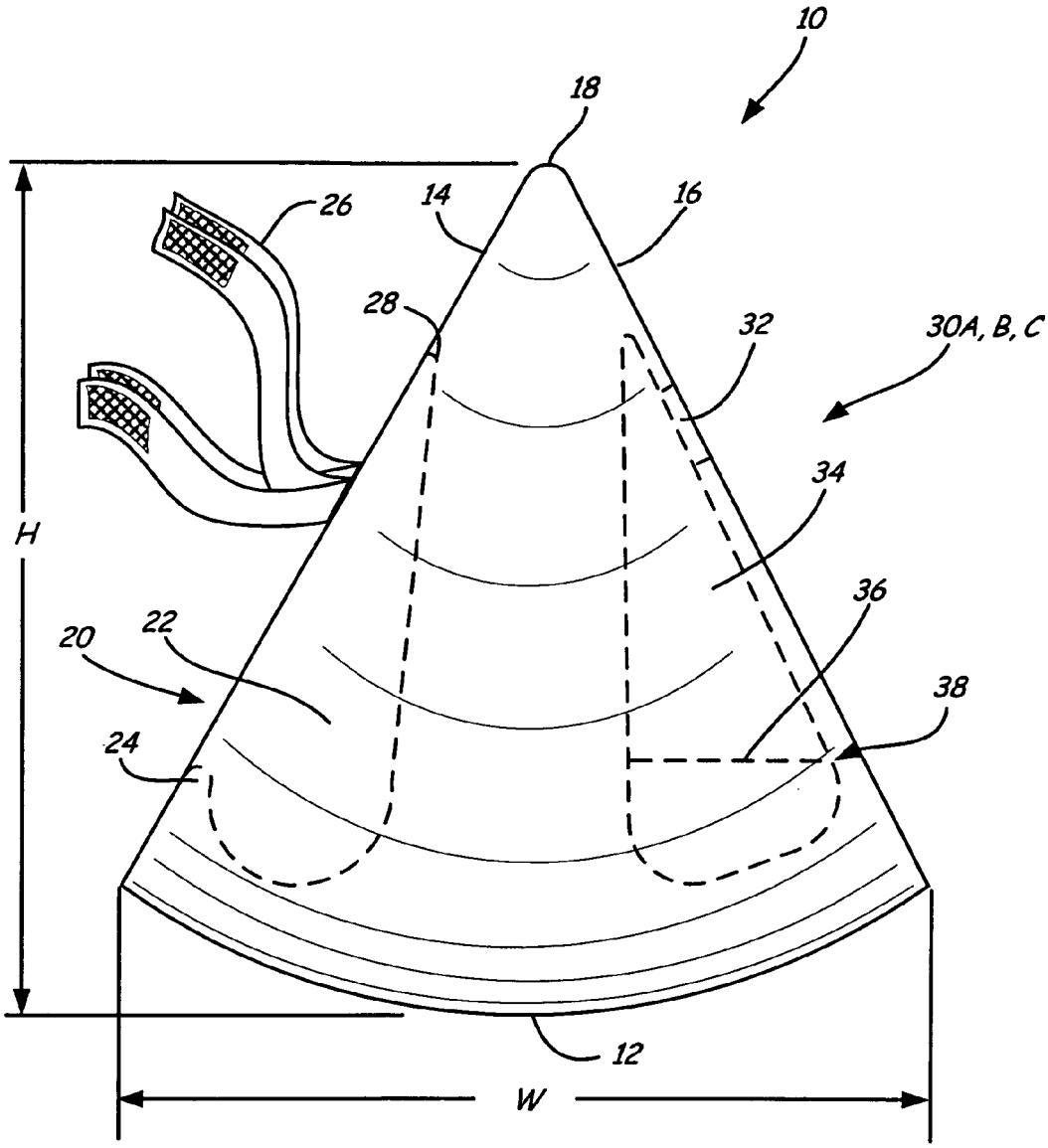
FIG. 3 is a side view of the embodiment shown in FIG. 1 and FIG. 2.

FIG. 1 and FIG. 2 are perspective views of embodiments of the present disclosure, and FIG. 3 is a side view of the embodiments described with reference to FIG. 1 and FIG. 2. Device 10 has an arcuate surface 12 extending from end region 13 to end region 15, and having a width (labeled in FIG. 3), enabling device 10 to sit stably along the arcuate surface 12 when set upon a ground surface. The width of the arcuate surface 12 can be in the range of about 8 to 24 inches, but is preferably in the range of about 10 to 16 inches. This width may remain substantially the same along the arcuate surface 12 from end region 13 to end region 15, or, as shown in FIGS. 1-3, may gradually decrease from the center of the device toward the end regions 13 and 15, where the width may reach a value of close to zero at pointed ends. In the case of flat end regions (not shown), the width may reach a value in the range of about 2 to 8 inches, with a preferred range of about 3 to 5 inches. Arcuate surface 12 may comprise rubber, treads, or any other suitable materials or structures for increasing the frictional properties of arcuate surface 12 such that it can adequately grip the ground and prevent sliding when performing the exercise described with reference to FIG. 4. Surface 14 and surface 16 extend radially from the arcuate surface 12 and may converge at region 18 to define a body therein, or may not converge but rather meet with another surface (not shown), for example. The length of the body (labeled in FIG. 1), measured along region 18, may be in the range of about 16 to 36 inches, but is preferably in the range of about 26 to 32 inches. The body may either comprise a hollow internal space, or may be of a substantially solid construction throughout. Device 10 may comprise molded plastic, wood, metal, or any material durable enough to retain the integrity of the device 10 under normal conditions for its use. Although surfaces 12, 14 and 16 are shown as being substantially planar, it may be appreciated that one or more of these surfaces could comprise a latticework structure or frame-like supporting members to generally define the overall geometries of device 10.

FIG. 1 further shows an embodiment of the present disclosure for retaining the feet of a user in connection with device 10. Foot retaining structures 20 each comprise a recess 22 for receiving the sole of a foot, lip 24 for securing the toe of a foot opposite heel end 28, and can include straps 26 for providing extra support for retaining the top of a foot. Preferably, the recesses 22 should be sized such that a reasonable range of foot sizes may be securely retained by foot retaining structures 20. For example, shoe sizes around 5-13 for men and around 5-12 for women could be retained by structures 20. Straps 26 may comprise, for example, buckles, button snaps, Velcro, laces that can be tied together by the user, or any other known methods for securing the top of a foot. The heel end 28 may either be recessed relative to surface 14, or may gradually merge with surface 14 to allow easy sliding of a foot down into recesses 22. Furthermore, it may be appreciated that foot retaining structures could alternatively lack recesses 22, but rather comprise straps 26 and lip 24, wherein the sole of a foot would rest on surface 14 and lip 24 would rise above the plane of surface 14 to accommodate insertion of the toe end of a foot. It may also be appreciated that any boot, shoe or foot retaining structures commonly used on skies, boards, or other sporting equipment could be used to retain a user's feet on device 10.

FIG. 2 further shows an embodiment of the present disclosure for retaining weight in connection with device 10. Weight retaining structures 30A, 30B, and 30C each comprise an opening 32 and pocket 34, containing a weighted material 36. Opening 32 may be sealed off with a plug, cap or other mechanism (not shown). Weighted material 36 may comprise, for example, water or sand, wherein the weight added to a pocket 34 will be a function of the level 38 of water or sand added to the pocket. In this way, a user can control the amount of weight retained by each weight retaining structure 30A, 30B, and 30C to increase or decrease the difficulty of the exercise using device 10. Weighted material may also comprise, for example, a weight core made of metal that can be slid through an opening, such as opening 32, and secured in place into an appropriately sized recess or other receiving structure built on or in the device 10. Alternatively, weights such as dumbbells or weightlifting plates could be attached to surface 16 or recesses formed in surface 16, for example, via straps, hooks, snaps, or other fastening structures.

Beyond controlling the overall weight of the device, the inertia that must be overcome by the user to perform the exercise described with reference to FIG. 4 may also be controlled by providing multiple weight retaining structures 30A, 30B, and 30C distributed throughout the device 10, while still allowing adjustment for other abdominal exercises to be performed. For example, adding weight with both or either of the structures 30A and 30C will increase the amount of work required to perform the exercise described with reference to FIG. 4, whereas taking away this weight and adding weight with only structure 30B will decrease the difficulty while still increasing the amount of work required to perform the leg-raise exercise described with reference to FIG. 6. Any number of combinations of adding or subtracting weight among the weight retaining structures 30A, 30B, and 30C are possible for controlling the degree of difficulty of each exercise using device 10. Furthermore, it may be appreciated that any number of weight retaining structures may be provided in device 10 as needed. Alternatively, device 10 may be manufactured having a specified weight and weight distribution customized for a particular application, with or without the weight retaining structures 30A, 30B, and 30C.

Figure 4:
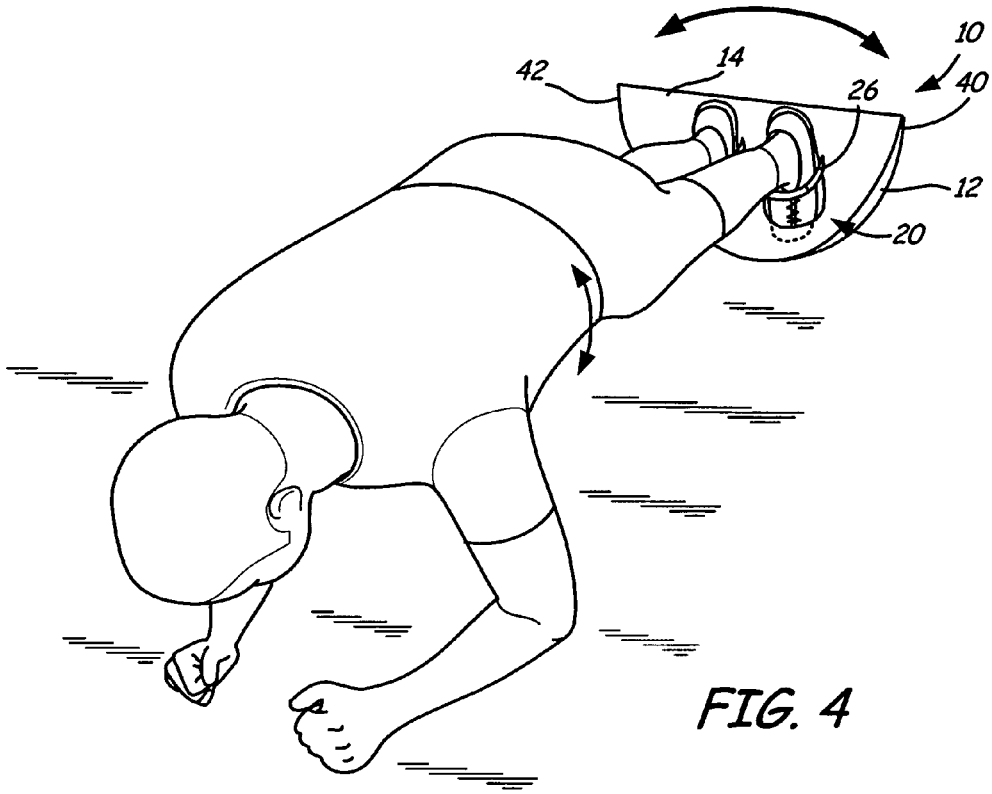
FIG. 4 shows a user in the bridge stance exercising the oblique abdominal muscles.

FIG. 4 shows a user in the bridge stance exercising the oblique abdominal muscles using an embodiment of the present disclosure. A bridge stance is performed by positioning the body generally parallel to the ground and supporting the weight of the body on the forearms and tips of the toes. By holding this static posture, the abdominal muscles as well as other muscles of the body are worked isometrically. However, when the user assumes a bridge stance with feet attached to device 10, the user can then force rotation of the lower body with the oblique abdominal muscles through a dynamic range of motion between location 40 and location 42 of device 10, such motion being guided and stabilized by the arcuate surface 12 of the device 10 in contact with the ground. In this way, the abdominal muscles will be worked both isometrically and isotonically in a safe and challenging manner. Furthermore, unlike non-machine based upright torso or waist twist exercises, the user may practically eliminate the issue of cheating via momentum. This can be done by simply slowing the rotational movement until reaching either location 40 or 42, at which point the user may temporarily hold the position at this location before slowly rotating back again. It may also be appreciated that the user can choose to support their weight with their hands by assuming a push-up position, or any other stance allowing the free rotation of the lower body with device 10.

Figure 5:
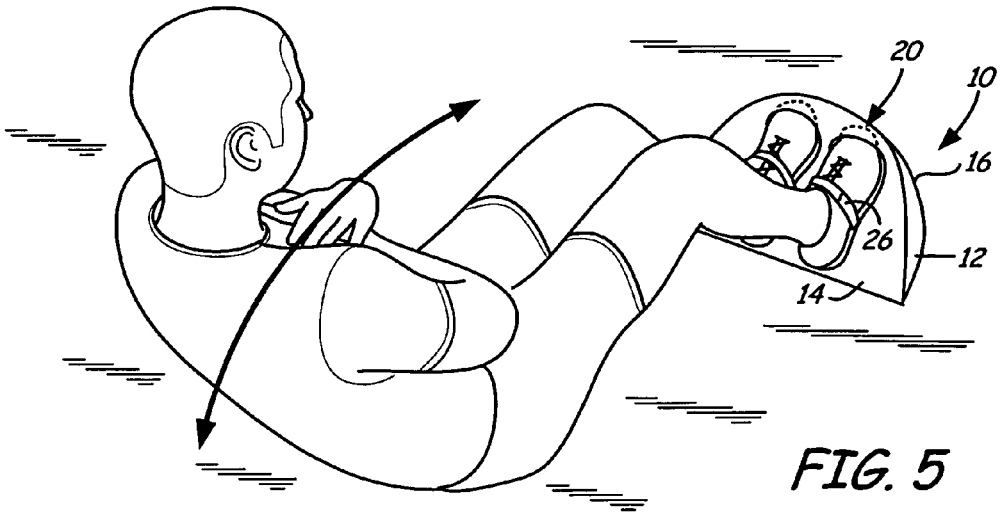
FIG. 5 shows a user performing sit-ups.

FIG. 5 shows a user performing sit-ups using an embodiment of the present disclosure. To efficiently transition from the exercise described with reference to FIG. 4 into the exercise of FIG. 5, the user may simply roll over with feet still attached. In this position, surface 16 lies flush with the ground to stabilize the position of the feet and legs of the user, wherein the weight of the device 10 functions as a counterweight to prevent the user's feet from lifting off the ground while performing the exercise. It may be appreciated that crunches or other abdominal exercises may be performed using device 10 as a counterweight and stabilizer.

Figure 6:
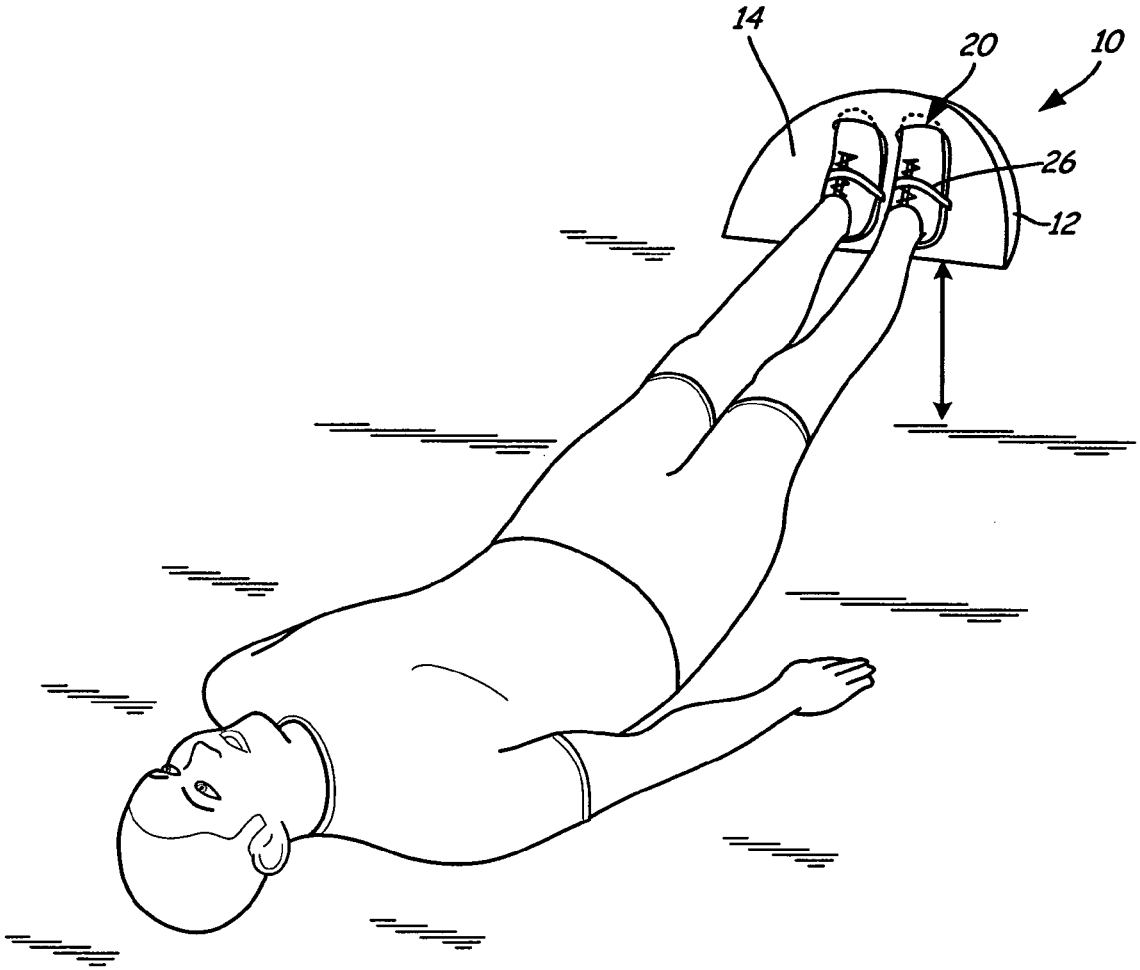
FIG. 6 shows a user performing abdominal leg raises.

FIG. 6 shows a user performing leg raises using an embodiment of the present disclosure. In this embodiment, the user may simply transition from doing the sit-up exercise of FIG. 5, for example, to weighted leg raises. This can be performed by laying flat on the ground and raising the legs upward with knees bent or legs straight and feet attached to device 10.

One skilled in the art may appreciate that the exercises described in the present disclosure may be performed in any order using device 10, and that further uses of device 10 can be envisioned in combination with a wide variety of known exercises not specifically disclosed herein. Regardless of the order or combination of exercises performed, device 10 enables a series of movements to be performed that exercise the abdominal muscle group in a safe, effective, and efficient manner made possible by the optimized geometry of the device and other characteristics described in the present disclosure. Although the present invention has been described with reference to preferred embodiments, workers skilled in the art will recognize that changes may be made in form and detail without departing from the spirit and scope of the invention.

The invention claimed is:

1. A multipurpose exercise device, comprising:

an arcuate surface opposite a non-arcuate end, wherein the arcuate surface meets the non-arcuate end at a first end region and at a second end region, and wherein the arcuate surface is curved in two orthogonal directions and has side-to-side curvature;

a first side opposite a second side, each side extending between the arcuate surface and the non-arcuate end to define a body; and foot attachment means for securing and attaching a person's feet to the first side, and for orienting the feet with toes pointed in a direction generally opposite the non-arcuate end.

2. The multipurpose exercise device of claim 1, wherein the arcuate surface comprises a friction enhancing material.

3. The multipurpose exercise device of claim 2, wherein the friction enhancing material comprises rubber.

4. The multipurpose exercise device of claim 1, further comprising weight retaining means for retaining weight on the second side.

5. The multipurpose exercise device of claim 1, wherein a cavity for receiving weight is in the body and is accessible from the second side.

6. The multipurpose exercise device of claim 5, wherein the weight comprises water.

7. The multipurpose exercise device of claim 5, wherein the weight comprises sand.

8. The multipurpose exercise device of claim 1, wherein the arcuate surface has a width in the range of about 8 to 24 inches.

9. The multipurpose exercise device of claim 1, wherein the arcuate surface has a width in the range of about 10-16 inches.

10. The multipurpose exercise device of claim 1, wherein the body has a length of about 16 to 36 inches.

11. The multipurpose exercise device of claim 1, wherein the body has a length of about 26 to 32 inches.

12. A multipurpose exercise device, comprising:

a body defined by an arcuate side, a first wall, a second wall and a straight end, wherein the first wall and the second wall converge radially from the arcuate side toward the straight end, and wherein the arcuate side meets the straight end at a first end region and at a second end region, and wherein the arcuate surface is curved in two orthogonal directions and has side-to-side curvature; and foot retaining recesses in the first wall configured to secure and attach feet to the body and to orient the feet with toes pointed in a direction substantially opposite the straight end.

13. The multipurpose exercise device of claim 12, further comprising a weight retaining structure adjacent the second wall and configured to secure weight to the device.

14. The multipurpose exercise device of claim 13, wherein the weight retaining structure comprises a cavity accessible through the second wall for receiving weight.

15. The multipurpose exercise device of claim 14, wherein the weight comprises water.

16. The multipurpose exercise device of claim 14, wherein the weight comprises sand.

17. The multipurpose exercise device of claim 12, wherein a surface of the arcuate side comprises a friction enhancing material.

18. The multipurpose exercise device of claim 17, wherein the friction enhancing material comprises a rubber composite.

19. The multipurpose exercise device of claim 12, wherein the arcuate side has a width in the range of about 8 to 24 inches.

20. The multipurpose exercise device of claim 12, wherein the arcuate side has a width in the range of about 10-16 inches.

21. The multipurpose exercise device of claim 12, wherein the body has a length of about 16 to 36 inches.

22. The multipurpose exercise device of claim 12, wherein the body has a length of about 26 to 32 inches.

* * * * *